US005353848A

United States Patent [19]

Gates et al.

[11] Patent Number: 5,353,848

[45] Date of Patent: Oct. 11, 1994

[54] METHOD OF FILLING GAS CYLINDERS

[75] Inventors: Robert G. Gates, Mendham; Shuen-Cheng Hwang, Chester; Ramachandran Krishnamurthy, Piscataway, all of N.J.

[73] Assignee: The BOC Group, Inc., New Providence, N.J.

[21] Appl. No.: 53,983

[22] Filed: Apr. 27, 1993

[51] Int. Cl.[5] ..... B65B 3/04

[52] U.S. Cl. ..... 141/9; 141/20; 141/83; 141/104; 141/105

[58] Field of Search ..... 141/3, 9, 20, 83, 104, 141/105

[56] References Cited

U.S. PATENT DOCUMENTS

| | | | |
|---|---|---|---|
| 3,653,414 | 4/1972 | Weidner | 141/9 X |
| 3,937,257 | 2/1976 | Biro | 141/3 |
| 4,010,777 | 3/1977 | Mogensen | 141/9 X |
| 4,146,066 | 3/1979 | Dietrich et al. | 141/9 |
| 4,262,713 | 4/1981 | Egami | 141/9 |
| 4,688,946 | 8/1987 | Latif et al. | 141/3 X |
| 4,718,462 | 1/1988 | Fix | 141/9 |

*Primary Examiner*—Ernest G. Cusick

*Attorney, Agent, or Firm*—Coleman R. Reap; Larry R. Cassett

[57] ABSTRACT

Uniform dispersion of mixtures of gases of different densities in gas vessels is rapidly attained by introducing the gases into the vessels in the order of their increasing densities while the vessels are in the upright position. When the quantities of the denser gases are small relative to the quantity of the least dense gas the gases are preferably metered into the vessels by pressure measurements, with the final pressures of the more dense gases being determined by differential pressure gauge measurements.

18 Claims, 1 Drawing Sheet

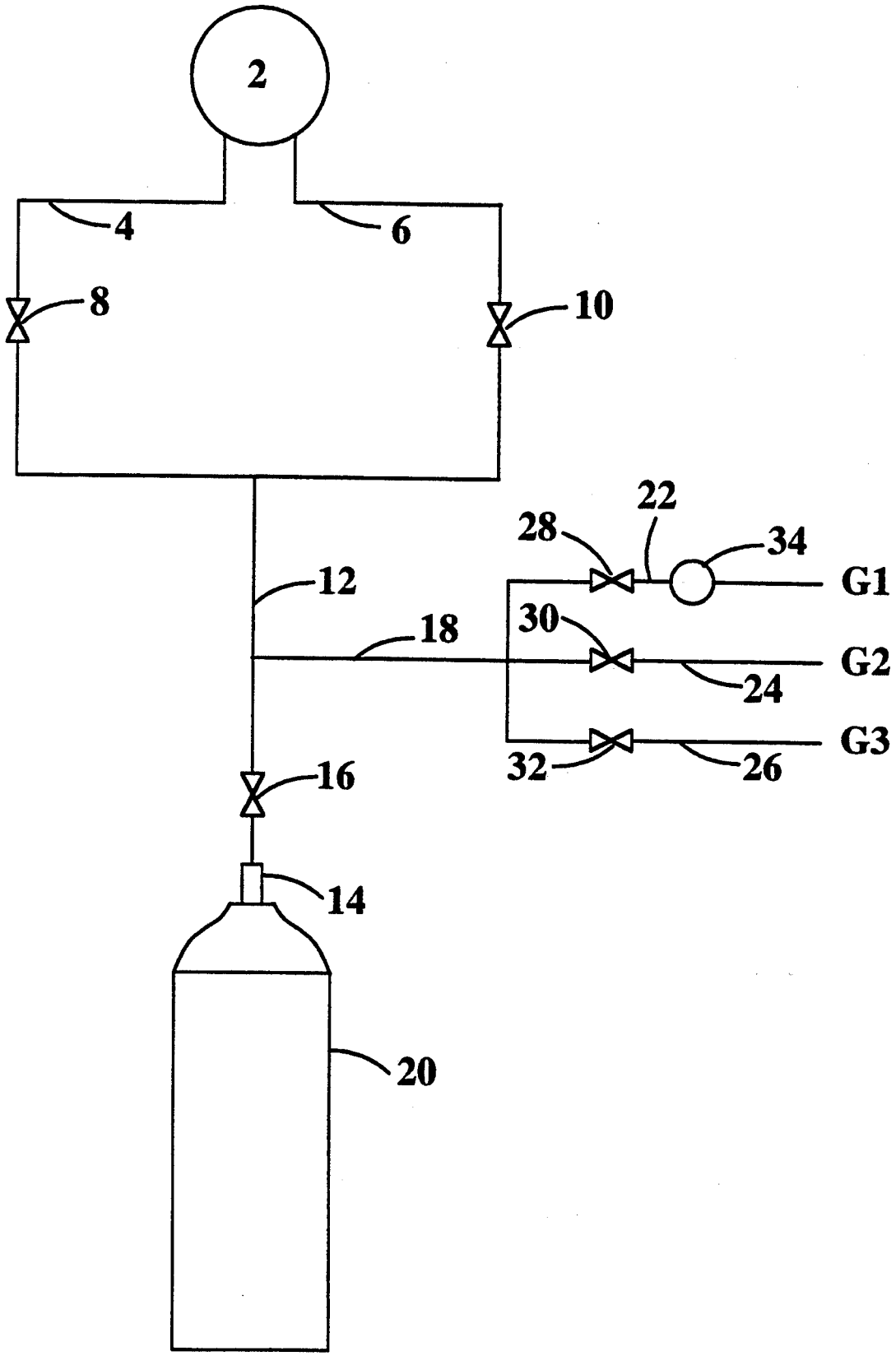
2
4
6
8
10
12
18
22
28
34
G1
30
G2
24
G3
32
26
16
14
20

METHOD OF FILLING GAS CYLINDERS

BACKGROUND OF THE INVENTION

This invention relates to gas cylinder filling methods, and more particularly to filling vessels with gas mixtures by pressure measurement techniques with gas mixtures comprising a major component and one or more minor components wherein the major component has a lesser density than at least one of the minor components.

Users of gas mixture products often have a need for uniform mixtures of gases at precise concentrations. However, because of certain conventional gas cylinder filling techniques, gas mixtures sold in containers such as gas cylinders are not always well mixed and do not always contain the desired concentration of each component. Generally, when two or more gases are charged into a gas cylinder, stratification of the gases in the cylinder will exist until the gas mixture reaches equilibrium. In the case of high pressure gas mixtures, this can take long periods of time, on the order of several days or more, unless special measures to mix the cylinder contents are undertaken.

The problem of stratification of components of a gas mixture in a newly filled cylinder can be pronounced when a gas mixture comprising a very small amount, for example about 1%, of one gas and about 99% of a second gas (by volume) is charged into a gas cylinder. When filling gas cylinders with mixtures of gases by pressure filling procedures it is customary to introduce the minor component into the cylinder first using a low pressure gauge to ensure a more precise transfer of the desired quantity of the minor component. Since precision pressure gauge readings are usually accurate to within about 0.1% of full scale, the error will be small when this procedure is used. If the minor component is lighter than the major component, relatively rapid mixing of the gases will occur. However, if the minor component has a greater density than the major component and the minor component is charged to the cylinder first, it will take considerably longer for the gas mixture to reach uniform concentration throughout the cylinder because gravitational forces impede upward movement of the more dense gas. Consequently, when the gas user requires a homogeneous gas mixture, the cylinder must be stored sufficiently long for substantially complete mixing to occur before the cylinder can be put into service, or measures taken to effect homogenization of the gas mixture.

Uniform mixing during filling of gas cylinders containing gas mixtures is also important because it minimizes temperature variation throughout the gas mixture, which in turn ensures more accurate measurement by pressure of the quantity of each component of the gas mixture introduced into the cylinder.

Various efforts have been undertaken to effect a more rapid mixing of gas mixtures in cylinders. One technique is to introduce the lighter gas component into the bottom part of the cylinder by means of a mixing tube. This will force the light gas to migrate upwardly through the heavy gas, thereby causing the gases to mix. Another technique is to roll the cylinders until the contents are uniformly mixed. Each of these procedures requires considerable handling of the cylinders, which increases the cost of filling the cylinders with gas mixtures.

Because of the importance of attaining immediate homogeneity of vessel-contained gas mixtures, methods of effecting more rapid mixing in vessels of gas mixtures comprising a minor component that has a greater density than the major component are continuously sought. The present invention provides such a method.

SUMMARY OF THE INVENTION

According to the method of the invention, rapid mixing to homogeneous mixtures of two or more gases in vessels, such as gas storage vessels and gas phase reaction vessels, is attained by charging the desired quantity of each gas into the vessels in the order of their increasing densities. The invention is particularly advantageous when a large quantity of a light gas is mixed with a small quantity of a gas having a density greater than the density of the light gas.

The invention can be applied to the mixing of two or more gases wherein the mixed gas composition includes a large quantity of a first gas of a given density and a small quantity (relative to the quantity of the first gas) of a second gas having a density greater than the density of the first gas.

In a preferred embodiment of the invention the quantities of gases introduced into vessels are determined by pressure measurements.

According to another aspect of the invention the quantities of one or more of the subsequently added gases, i.e. those gases added to the vessel after introduction of the first gas into the vessel, are measured by means of a narrow pressure range differential pressure gauge. Precision of measurement of the quantities of the subsequently added gases is achieved by pressure filling the vessel with the first introduced gas to a given pressure value and then introducing the subsequently added gases into the vessel using differential pressure techniques to measure the quantities of the subsequently added gases, with the given pressure value as the reference point for the differential measurements. A narrow range, high sensitivity pressure gauge can be used to make the differential pressure measurements.

In a more specific embodiment of this aspect of the invention, the gases are added in the order of their increasing densities. According to this more specific embodiment, the least dense gas is charged first into the vessel to a given pressure, and the more dense gases are introduced into the vessel in the order of their increasing densities using the above-described differential pressure measuring techniques to measure the quantities of the more dense gases.

BRIEF DESCRIPTION OF THE DRAWING

The drawing shows a schematic representation of a system for filling gas cylinders in accordance with a preferred embodiment of the invention.

DETAILED DESCRIPTION OF THE PREFERRED EMBODIMENTS

Although the invention is applicable to the filling of any type of vessel with a gas mixture, it is particularly useful for filling long storage vessels of relatively small cross-section, which are normally filled, stored, shipped and used in the upright position, i.e. positioned with the major axis vertical or nearly vertical and with the fill port located at the top end of the vessel. An example of such a gas storage vessel is the standard portable gas cylinder. The vessels are filled while in the upright position, and due to the unique filling sequence of the invention the gases rapidly mix in the upright cylinders without having to roll the cylinders or otherwise agitate their contents.

In detail, the sequence of the filling steps of the invention is as follows: a given quantity of a first gas of low density, such as helium, is charged into a vessel. Next, a given quantity of a second gas of greater density than the first gas is charged into the vessel. If the gas mixture product is to comprise more than two gases the remaining gases are charged into the vessel in the order of their increasing densities. If the finished gas mixture comprises only two gases then, according to the invention, the quantity of the second gas should be less than the quantity of the first gas. If the mixture is to comprise more than two gases, at least one of the second or later added gases should be charged into the vessel in a quantity less than the quantity of an earlier added gas. For example, if only two gases are charged into the vessel, the quantity of the second gas (which is of greater density than the first gas) should be less than the quantity of the first gas. However if the final mixture is to comprise three gases, the gases are added in the order of their increasing densities, and the last charged gas should be added in a quantity less than the quantity of the first added gas and/or the quantity of the second added gas. It can also be appreciated that in the case of gas mixtures of three gases the quantity of the second added gas may exceed the quantity of the first added gas.

The principle of the invention also applies to mixtures of four or more gases: the gases are added in the order of their increasing densities, and the quantity of one or more gases is less than the quantity of at least one other gas that was added to the vessel prior to the addition to the vessel of the one or more gases.

The invention operates as follows: When the first added gas is charged to the vessel it will occupy the full volume of the vessel. As each subsequently added gas is charged into the vessel it will gravitate to a position in the vessel below the previously added gases, thereby causing blending in the gas mixture. This automatically results in mixing of the gases in the vessel. By virtue of the invention the need for rolling or additional agitation of the vessel contents is eliminated.

The method of the invention differs from the prior art method of filling gas vessels in that in prior art procedures the gases are added in the order of their increasing quantities, rather than in the order of their increasing densities. The disadvantage of the prior art procedure is that if the quantities of the added gases are such that the gases are added in the order of their decreasing densities the gravity mixing benefit of the invention will not be realized.

Examples of gas compositions for which the invention is applicable are mixtures such as inert gas compositions comprising 90% nitrogen and 10% argon; and 99% helium and 1% neon; and welding gases comprising 75% helium, 1% oxygen and 24% argon.

Another important facet of the invention is the procedure for measuring the quantity of each component of the gas mixture. This aspect of the invention is described with particular reference to the appended drawing. The drawing shows a system for measuring the quantities of three gases introduced into a gas cylinder. The system of the drawing comprises a highly sensitive, narrow pressure range differential pressure gauge 2, which measures the difference in pressure between lines 4 and 6, sources of gas $G_1$, $G_2$ and $G_3$ and connecting conduits. Gas $G_1$ is the least dense gas, gas $G_2$ is the second least dense and gas $G_3$ is the most dense gas. Gauge 2 can be of any desired type, such as an elastic element gauge, for example, a Boutdon tube, bellows or diaphragm element gauge. Line 4 is connected to a chamber on one side of the elastic element of gauge 2 and line 6 is connected to a chamber on the other side of the element. Valves 8 and 10 control flow of gases through lines 4 and 6, respectively. Lines 4 and 6 connect to line 12, which in turn is connected to gas cylinder fill connection 14. Flow through line 12 is controlled by valve 16. One end of line 18 joins line 12 upstream of valve 16 and the other end of line 18 joins lines 22, 24 and 26, and the latter lines are connected to sources of gas $G_1$, $G_2$ and $G_3$, respectively. Gas flow through lines 22, 24 and 26 is controlled by valves 28, 30 and 32, respectively. In the embodiment illustrated in the drawing a pressure gauge, 34, is located in line 22. Also included in the drawing is a gas cylinder 20, shown attached to fill connection 14 for filling.

In filling a gas cylinder according to one procedure using the system of the drawing, valves 8, 10, 16 and 28 are opened and valves 30 and 32 are closed. Gas $G_1$ is charged into gas cylinder 20 until the desired quantity is transferred, as measured by pressure gauge 34. The reading on gauge 2 will remain at zero since both sides of the elastic element of this gauge are open to line 12. At this point valves 8 and 28 are closed and valve 30 is opened and gas $G_2$ is permitted to flow into cylinder 20 until the desired quantity of this gas is transferred to cylinder 20, as measured by differential gauge 2. At this point, valve 30 is closed and valve 8 may be opened to equalize both sides of the elastic element in gauge 2, which will cause the needle in gauge 2 to return to zero. Alternatively, valve 8 can be kept closed and measurements of the third gas component can be made on a cumulative basis. Valve 32 is then opened and the desired quantity of gas $G_3$ is transferred into cylinder 20, again as measured by the pressure reading on gauge 2. At this point cylinder 20 has received its full charge of gas. Valves 16 and 32 are closed and cylinder 20 can be removed, and the system can be used to fill another gas cylinder.

The invention is further illustrated by the following examples, in which parts, percentages and ratios are on a mole basis. In the examples gas cylinder bottles are filled in the upright position with mixtures of helium and argon to a final pressure of 2500 pounds per square inch absolute (psia), all pressures being measured at 20° C. The target gas composition in each example is 92.5 mole % helium and 7.5 mole % argon.

EXAMPLE I (COMPARATIVE)

In this example a gas cylinder is charged first with argon to a pressure of 170.9 psia and then filled with helium to a final pressure of 2500 psia. It was predicted, based on thermodynamic calculation, that this procedure would result in a final mixture comprising 92.5% helium and 7.5% argon. Pressure measurement during the argon and helium fills were made using a 1000 psia gauge and a 3000 psia gauge, respectively. After the cylinder was filled the gas mixture was analyzed and found to have an argon concentration of less than 1%. The gas mixture was then released from the cylinder and periodic analyses of the mixture issuing from the cylinder were made during the gas release. The argon concentration increased continuously as the cylinder was emptied, reaching a concentration of approximately 2.5% when the cylinder pressure was about 1000 psia and a concentration of 16.2% when the cylinder pressure was approximately 500 psia. This example shows that the gas mixture in the cylinder was not uniform but was stratified in the cylinder at the completion of filling.

EXAMPLE II (COMPARATIVE)

The procedure of Example I was repeated except that the cylinder contents was mixed by gently heating one side of the cylinder for several days, thereby promoting convective mixing of the gases in the cylinder. The cylinder was then emptied with periodic gas concentration measurements being made, as in Example I. The argon concentration was found to be 7.4% (±0.2%) during the cylinder depressurization.

EXAMPLE III

The procedure of Example I was repeated except that first helium and then argon was introduced into the cylinder. The helium was charged into the cylinder until the pressure in the cylinder reached 2284.5 psia (predicted by thermodynamic calculation to produce a mixture containing 92.5% helium and 7.5% argon). The cylinder was then filled with argon to a final pressure of 2500 psia. Both pressures were measured at 20° C., using a 3000 psia pressure gauge, according to conventional procedures. The mixture was analyzed soon after filling and the argon concentration was found to be 6.8%. The gas mixture was released from the cylinder with periodic analysis of the released gas mixture, as in Example I. The argon concentration of the mixture was found to be constant at 6.8% (±0.2%). This example demonstrates that when preparing a mixture of a high density gas and a low density gas in a gas cylinder, charging first the low density gas and then the high density gas into the cylinder results in a substantially uniform mixture throughout the cylinder.

EXAMPLE IV

The procedure of Example III was repeated except that the helium was charged into the cylinder to a pressure of 2284.5 psia using a 0–3000 psi range gauge, and then argon was charged into the cylinder to a final pressure of 215.5 psia by differential pressure measurement using a 0–300 psi range gauge (215.5 psi above 2284.5 psia), as detailed above. When the cylinder was analyzed after filling, the argon concentration was found to be 7.4% and the argon concentration remained constant (7.4%±0.2%) as the gas was released from the cylinder. This example shows that when a gas cylinder is filled with a gas mixture according to the procedure of the invention the mixture will rapidly become homogeneous. This example also shows that gas mixtures of desired concentrations can be accurately made by the differential pressure filling technique of the invention.

Although the invention has been described with particular reference to specific examples, it is understood that variations are contemplated. For example, the invention can be used to charge three or more gaseous reactants of different densities into reaction vessels. Furthermore, the measurement of gases charged into vessels can be effected by differential pressure measuring systems other than the one illustrated in the drawing. The scope of the invention is limited only by the breadth of the appended claims.

What is claimed is:

1. A method of introducing two or more gases of different densities into a vessel wherein the quantity introduced and density of one gas is greater and lower, respectively, than the quantity introduced and density of one other gas, comprising successively introducing the gases into said vessel in the order of their increasing densities while said vessel is in the upright position.

2. The method of claim 1, wherein said one gas and said one other gas are introduced into said vessel in mole percentages of about 30 to 99.5% and about 0.5 to 30%, respectively, based on the total volume of gas introduced into said vessel.

3. The method of claim 1, wherein said vessel is a reactor.

4. The method of claim 3, wherein said vessel is a gas cylinder.

5. The method of claim 1, wherein the least dense gas is introduced into the vessel until the pressure in the vessel reaches a predetermined value and the quantity of at least one of the remaining gases introduced into the vessel is determined by differential pressure measurement.

6. The method of claim 5, wherein the quantities of each of the remaining gases introduced into the vessel is determined by differential pressure measurement.

7. The method of claim 5, wherein a total of two gases is introduced into said vessel.

8. The method of claim 7, wherein the two gases introduced into said vessel are nitrogen and argon, helium and argon or helium and neon.

9. The method of claim 6, wherein a total of three gases is introduced into said vessel.

10. The method of claim 9, wherein the gas combination introduced into said vessel comprises, on a mole basis, about 60 to about 80% of the least dense gas, about 15 to about 40% of a second gas and up to about 5% of a third gas.

11. The method of claim 10, wherein said least dense gas is helium, said second gas is argon and said third gas is oxygen.

12. A method of introducing two or more gases into a vessel wherein a first gas is introduced into the vessel until the pressure in the vessel reaches a preset fixed reference point and the quantity of at least one of the remaining gases introduced into the vessel is determined by differential pressure measurement relative to said preset.

13. The method of claim 12, wherein the quantities of each of the remaining gases introduced into the vessel is determined by differential pressure measurement relative to said preset fixed reference point.

14. The method of claim 13, wherein the gases are introduced into said vessel in the order of their increasing densities.

15. The method of claim 14, wherein a total of two gases is introduced into said vessel.

16. The method of claim 15, wherein the two gases are nitrogen and argon, helium and argon or helium and neon.

17. The method of claim 14, wherein a total of three gases is introduced into said vessel.

18. The method of claim 1, wherein said vessel is a storage value.

* * * * *